US005535461A

United States Patent [19]

Schwender

[11] Patent Number: 5,535,461

[45] Date of Patent: Jul. 16, 1996

[54] SUN BATHING TOWEL SYSTEM

[76] Inventor: Mary E. R. Schwender, 927 B Saint Ann St., New Orleans, La. 70116-3030

[21] Appl. No.: 356,563

[22] Filed: Dec. 15, 1994

[51] Int. Cl.[6] ..... A47G 9/06; A45C 3/10

[52] U.S. Cl. ..... 5/420; 5/419; 5/656; 297/377

[58] Field of Search ..... 5/419, 417, 420, 5/418, 482, 656, 657; 135/118; 297/377; 190/1, 2; 383/4

[56] References Cited

U.S. PATENT DOCUMENTS

| | | | |
|---|---|---|---|
| D. 322,532 | 12/1991 | Kumar et al. | D6/596 |
| D. 341,285 | 11/1993 | Kraus | D6/595 |
| D. 341,513 | 11/1993 | Reeves et al. | D6/608 |
| 1,891,747 | 12/1932 | Clements | 5/419 |
| 2,570,571 | 10/1951 | Leeman | 297/377 |
| 2,870,464 | 1/1959 | Lalick | 5/420 |
| 3,822,424 | 7/1974 | Messer | 5/419 |
| 4,375,901 | 3/1983 | McDonald | 297/377 |
| 4,466,516 | 8/1984 | Sicoli et al. | 190/2 |
| 4,546,507 | 10/1985 | Weinstein | 5/417 |
| 4,856,912 | 8/1989 | Damus et al. | 383/4 |
| 4,945,587 | 8/1990 | Ferro | 5/419 |
| 5,018,230 | 5/1991 | Steberger | 5/420 |
| 5,081,727 | 1/1992 | Ippolito | 5/419 |
| 5,101,525 | 4/1992 | Ippolito | 5/417 |
| 5,110,219 | 5/1992 | Lopes | 383/4 |
| 5,158,258 | 10/1992 | McFadzean | 248/500 |
| 5,245,715 | 9/1993 | Dinkins | 5/417 |
| 5,353,453 | 10/1994 | Naumann | 5/420 |
| 5,390,890 | 2/1995 | Ferguson et al. | 5/417 |

FOREIGN PATENT DOCUMENTS

| | | | |
|---|---|---|---|
| 0203221 | 12/1986 | European Pat. Off. | 5/417 |
| 182675 | 7/1922 | United Kingdom | 297/377 |
| 2180150 | 3/1987 | United Kingdom | 297/377 |

*Primary Examiner*—Alexander Grosz
*Attorney, Agent, or Firm*—Joseph N. Breaux

[57] ABSTRACT

A sun bathing towel system comprising a towel member and a plurality of stake members. The towel member has a perimeter and a plurality of towel eyelet members that define a like number of towel eyelet apertures. The towel eyelet members are located adjacent the perimeter of the towel member. Each of the stake members has a shaft portion and a detachably connectable cap portion. The cap portion has a broad top cap surface to prevent injury to any inattentive sun bather who may accidently step upon the stake member. In preferred embodiments, the sun bathing towel system further includes a liner member, a support pole structure, connectable with the towel member, for supporting a portion of the towel member in a lean-to type fashion; and an elongated flexible carrying strap. Food and drink items may be stored under the lean-to portion of the towel member to protect them from excessive exposure to the sun and the towel member may be configured into a tote/carrying bag configuration and carried with the carrying strap.

5 Claims, 3 Drawing Sheets

SUN BATHING TOWEL SYSTEM

TECHNICAL FIELD

The present invention relates to sun bathing towel systems which include a mechanism for securing a sun bathing towel to a sun bathing surface and more particularly to sun bathing towel systems which include a plurality of stake members for securing a sun bathing towel to a sun bathing surface.

BACKGROUND ART

Although sun bathing can be a relaxing activity, carrying all the items to and from a sun bathing location, such as a beach, can be aggravating. Also, when the wind is blowing, keeping a sun bathing towel anchored to the ground can also be a problem. In addition, the heat of the sun can cause food and drink items, brought to the sun bathing location, to become warm and/or spoiled. It would be a benefit, therefore, to have a sun bathing system which alleviated all or some of the foregoing problems.

The following patents are illustrative of various attempts made in the art to solve some of these problems.

| U.S. Pat. No. | Inventor |
|---|---|
| 5,081,727 | Ippolito |
| 4,856,912 | Damis et al. |
| 4,466,516 | Sicoli et al. |
| Des. 341,513 | Reeves et al. |
| Des. 341,285 | Kraus |
| Des. 322,532 | Kumar et al. |

Ippolito discloses a beach kit comprising a hollow, generally cylindrical, insulating foam pillow defining an insulated container having hinged covers at its ends, and a generally rectangular towel portion having, at one of its ends, holes adapted to accommodate anchoring stakes. The opposite end of the towel portion comprises a band of elastic material. The opposite end of the towel portion is folded over and secured to the towel body to define a loop portion of a diameter smaller than the diameter of the pillow so that the loop portion may be stretched and snugly removably secured to the pillow by the loop. The towel is adapted to be rolled around and retained on the pillow.

Damis et al. discloses a beach towel which is selectively convertible to a tote bag or beach bag wherein the towel has upper and lower surface portions having a generally annularly oriented pull cord substantially confined therebetween but extending outwardly on opposite sides of the towel so that as the outwardly extending portions of the pull cord are raised, the central portion of the towel surrounded by the pull chord will form a carrying pouch having an opening which is closed by the pull cord.

Sicoli et al. discloses a multi-purpose sunblanket and tote bag that is formed of a foldable blanket-like material in the form of a mat. The mat constitutes a substantially rectangular first area having a major axis and a minor axis in which the mat defines at least four substantially equally spaced fold lines disposed transversely to the major axis of the mat. The mat includes openings at the corners of the substantially rectangular mat to allow the mat to be staked to the ground during use.

Reeves et al. discloses a substantially rectangular shaped beach towel having a sealable compartment at one end and two loops attached to the other end. A pillow is disposed within the sealable compartment.

Kraus discloses a beach towel having five pockets. Two of the pockets are attached at one end. The other three pockets are located at the other end.

Kumar et al. discloses a combined beach towel, pillow, carrying strap, and convertible bag. The towel includes a zippered compartment at one end, a pillow installed within a pocket at the other end, and a elongated tab attached to the end having the zippered compartment. On one side of the tab is a section of hook material from a hook and pile type fastener. On the other side of the tab is a section of pile material from a hook and pile type fastener. The hook section and the pile section are positioned at locations along the elongated tab to allow the tab to circle the towel when it is rolled from the end containing the pillow.

None of the above described devices satisfactorily alleviates the above mentioned problems. In addition, some of the above mentioned devices increase the problems by including stakes which may pose the danger of injury to people who may inadvertently step or trip on them. Of the above mentioned devices, only Ippolito attempts to solve the problem of food and drink items warmed and/or spoiled by excessive heat from the sun. However, the size of the insulated compartment of Ippolito limits the amount of food and drink items which may be protected, and its sealed nature may allow unpleasant odors and/or unhealthy conditions to occur within the compartment.

GENERAL SUMMARY DISCUSSION OF INVENTION

It is thus an object of the invention to provide a sun bathing towel system which allows a sun bathing towel to be securely anchored without posing a danger to individuals.

It is a further object of the invention to provide a sun bathing towel system that allows sun bathing items to be conveniently carried to and from a sun bathing site.

It is a still further object of the invention to provide a sun bathing towel system that will provide protection for food and/or drink items from excessive exposure to the sun.

It is a still further object of the invention to provide a sun bathing towel system that which provides a moisture barrier for carrying wet items.

Accordingly a sun bathing towel system is provided comprising a towel member and a plurality of stake members. The towel member has a perimeter and a plurality of towel eyelet members that define a like number of towel eyelet apertures. The towel eyelet members are located adjacent the perimeter of the towel member. The towel member may be constructed from any material suitable for laying upon while sun bathing. Suitable materials would include canvas, terry cloth, and cotton toweling material. The towel eyelet members are preferably metal or plastic grommets having an aperture having a diameter between three-quarters of an inch and an inch and one-half.

Each of the stake members has a shaft portion and a detachably connectable cap portion. The shaft portion is preferably between three and six inches long and has a circular cross section having a diameter between one-fourth and one-half inches less than the diameter of the towel eyelet apertures. The cap portion has a broad top cap surface to prevent injury to the inattentive sun bather who may accidently step upon the stake member. The term "broad" is used herein to mean at least one and one-half inches in any planar dimension which intersects the center of the top cap surface. The cap portion preferably includes a disk shaped section of a thickness between one-sixteenth and one-half inches. The top cap surface is preferably circular shaped with a diameter of between three and four inches. The shaft portion and the cap portion are both preferably constructed from plastic. It is also preferred that the shaft portion and the cap portion include companionately threaded sections which allows the shaft portion to be connected to the cap portion. Although this is the preferred method of detachably connecting the cap portion to the shaft portion any means for forming a detachable connection between the two is sufficient to practice the invention. Having the cap portion detachable from the shaft portion allows the stake members to be more easily transported and stored when not in use.

In a preferred embodiment, the sun bathing towel system further includes a liner member, preferably constructed from a water proof or water resistant material. Examples of suitable materials would include plastic sheeting and fabrics having a water proof coating.

The liner member is of substantially the same size and shape as the towel member and includes a plurality of liner eyelet members. The liner eyelet members are preferably plastic or metal grommets of the same dimensions as the towel eyelet members. The liner eyelet members are located on the liner member in a manner to register with the locations of the towel eyelet members on the towel member when the towel member and the liner member are positioned one atop the other. The liner member includes an attachment mechanism for detachably connecting the liner member to the towel member. Examples of suitable attachment mechanisms would include zippers, snaps, and hook and pile type fasteners.

In another preferred embodiment, the sun bathing towel system further includes: a support pole structure, connectable with the towel member, for supporting a portion of the towel member in a lean-to type fashion; and the towel member includes at least one storage pocket for storing the support pole structure. The support pole structure may consist of two separate poles members but preferably includes first and second vertical pole members, and at least one horizontal connecting member. The horizontal connecting member is attachable between the first and second vertical pole members. The pole members and/or connecting member are preferably constructed of plastic. Food and/or drink items may be stored under the lean-to portion of the towel member to protect them from excessive exposure to the sun.

When the preferred support pole structure is used, the towel member preferably includes a tubular shaped structure having a first and second open end for receiving the horizontal connecting member. The tubular shaped structure is preferably located along a perimeter portion of the towel member, and is preferably constructed of the same fabric as the towel member.

In another preferred embodiment the sun bathing towel system further includes an elongated flexible carrying strap in functional connection with the towel member. The term "functional connection" is used herein to mean any physical connection whether directly between the carrying strap and the towel member or through the use of an intermediate part such as the liner member.

When a carrying strap is included in the sun bathing towel system, a first portion of the perimeter of towel member preferably includes an attachment mechanism for attachment to a second portion of the perimeter of the towel member in a manner such that the towel member forms a pouch for carrying typical sun bathing or sunbathing items such as sun tan lotion, small towels, reading materials, and bathing suits and the like.

In another aspect of the invention, a sun bathing towel system comprising a towel member, a plurality of stake members, and a support pole structure is provided. The towel member has a perimeter and a plurality of towel eyelet members, defining a like number of towel eyelet apertures. The towel eyelet members are located adjacent the perimeter of the towel member.

Each stake member has a shaft portion and a detachably connectable cap portion. The shaft portion is of dimensions sufficient to allow the shaft portion to pass through the towel eyelet apertures. The cap portion is of dimensions sufficient to block passage of the cap portion through the towel eyelet apertures.

The support pole structure is connectable with the towel member and is used for supporting a portion of the towel member in a lean-to type fashion. In this embodiment, the towel member also includes at least one storage pocket for storing the support pole structure when not in use.

The support pole structure preferably includes first and second vertical pole members, and at least one horizontal connecting member. The horizontal connecting member is attachable between the first and second vertical pole members.

In a preferred embodiment, the towel member includes a tubular shaped structure having a first and second open end for receiving the horizontal connecting member. The tubular shaped structure is preferably located along a perimeter portion of the towel member.

In another preferred embodiment, the sun bathing towel system further includes a liner member of substantially the same size and shape as the towel member having a plurality of liner eyelet members. The liner eyelet members are located on the liner member in a manner to register with the locations of the towel eyelet members on the towel member when the towel member and the liner member are positioned one atop the other. The liner member includes a mechanism for detachably connecting the liner member to the towel member.

In another preferred embodiment the sun bathing towel system further includes an elongated flexible carrying strap in function connection with the towel member.

In another preferred embodiment, a first portion of the perimeter of towel member includes a mechanism for attachment to a second portion of the perimeter of the towel member in a manner such that the towel member forms a pouch.

In a still further aspect of the invention, a sun bathing towel system comprising a towel member, a liner member, a plurality of stake members, and a support pole structure is provided.

The towel member has a perimeter and a plurality of towel eyelet members, defining a like number of towel eyelet apertures. The towel eyelet members are located adjacent the perimeter of the towel member. The towel member includes at least one storage pocket for storing the support pole structure when it is not in use.

The liner member is of substantially the same size and shape as the towel member and has a plurality of liner eyelet members. The liner eyelet members are located on the liner member in a manner to register with the locations of the towel eyelet members on the towel member when the towel member and the liner member are positioned one atop the other. The liner member has a mechanism for detachably connecting the liner member to the towel member.

Each stake member has a shaft portion and a cap portion. The shaft portion is of dimensions sufficient to allow the shaft portion to pass through the towel and liner eyelet apertures. The cap portion is of dimensions sufficient to block passage of the cap portion through the towel and liner eyelet apertures.

The support pole structure is connectable with the towel member, for supporting a portion of the towel member in a lean-to type fashion. The support pole structure preferably includes first and second vertical pole members, and at least one horizontal connecting member. The horizontal connecting member is attachable between the first and second vertical pole members.

In a preferred embodiment the sun bathing towel system further includes an elongated flexible carrying strap in functional connection with the towel member; and a first portion of the perimeter of towel member includes a mechanism for attachment to a second portion of the perimeter of the towel member in a manner such that the towel member forms a pouch.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
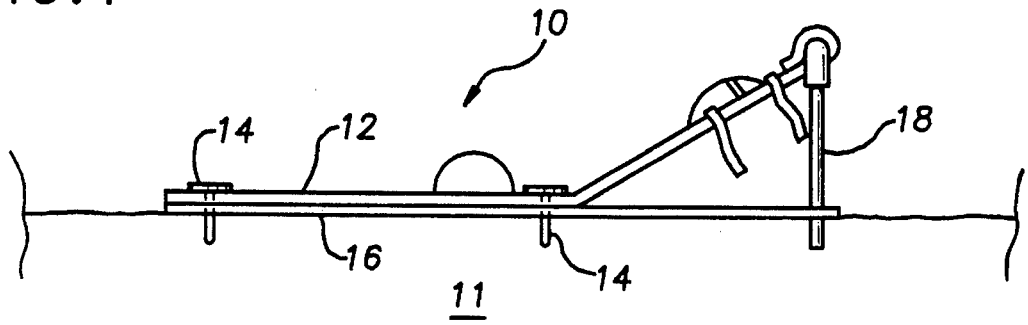
FIG. 1 is a side view of a preferred embodiment of the sun bathing towel system of the present invention positioned on a plot of sand.

FIG. 1 is a side view of an exemplary embodiment of the sun bathing towel system of the present invention, generally designated by the numeral 10, installed upon a plot of sand 11. In this exemplary embodiment, the sun bathing towel system includes a towel member, a liner member, four stake members, a support pole structure, and two carrying straps. FIG. 1 shows towel member 12, two of the four stake members 14, liner member 16, and support pole structure 18. Support pole structure 18 is shown supporting a section of towel member 12 in a lean-to configuration.

Figure 2:
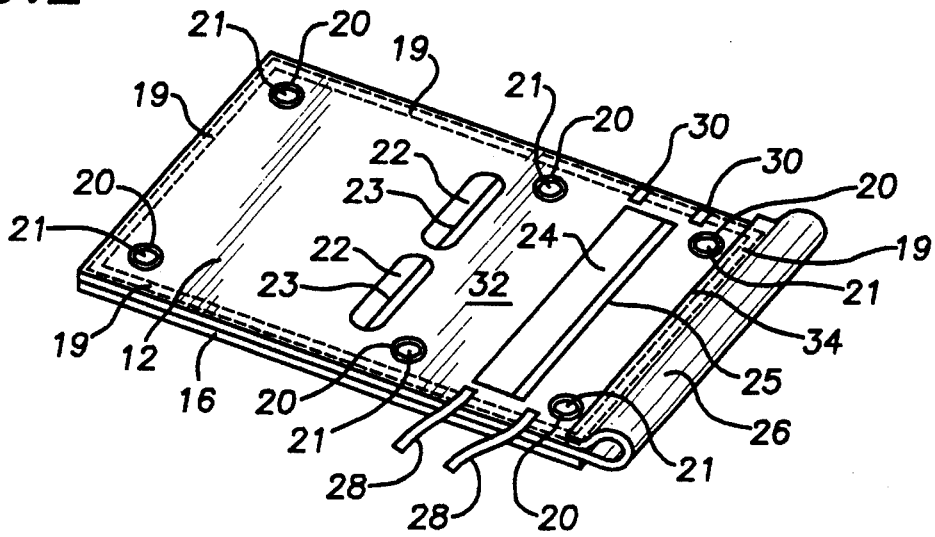
FIG. 2 is a top perspective view of the towel and liner members of the embodiment shown in FIG. 1.

FIG. 2 is a top view of the towel member 12 shown in FIG. 1. Towel member 12 includes six plastic towel eyelets 20, two pillow pockets 22, a support pole storage pocket 24, a tubular shaped connecting member receiving structure 26, and two securing tabs 28 which are attachable to two securing pads 30. Also shown in the figure is a portion of liner member 16.

Towel member 12 is constructed of a substantially rectangular shaped section of terry cloth fabric having a length of about 75 inches and a width of about 42 inches. Towel eyelets 20 are plastic grommets having an internal aperture 21 of about ½ inch in diameter. Four of the towel eyelets 20 are positioned at the four corners of towel member 12. The other two towel eyelets 20 are positioned along the perimeter of towel member 12 about twenty inches (20") away from receiving structure 26. This allows a section 32 of towel member 12 to be utilized, in combination with support pole structure 18, as a lean-to if desired. On the underside of towel member 12, a series of hook and pile fastener sections 19 (shown in dashed lines) are positioned along the perimeter.

The two pillow pockets 22 are each constructed from terry cloth fabric and are accessible through a flap 23. Installed within each pillow pocket 22 is an inflatable pillow (not shown) which may be inflated and deflated as desired. Support pole storage pocket 24 is similarly constructed and is provided with a flap 25 for allowing the insertion and removal of support pole structure 18 when disassembled.

Connecting member receiving structure 26 is integrally formed at one end 34 of towel member 12 by folding an end 34 of towel member 12 over and stitching it in place. In use, a horizontal connecting member, described herein further below, is installed through receiving structure 26 to provide support when section 32 is used in the lean-to configuration.

Securing tabs 28 are constructed from about a six inch length of nylon strapping material. Each securing tab 28 is stitched at one end to towel member 12 and has a three inch section 36 (shown in FIG. 3 ) of hook and pile type fastener attached at the free end. The sections 36 are attachable to securing pads 30 which are formed from three inch sections of complimentary hook and pile type fasteners that have been stitched to the opposite side of towel member 12.

Figure 3:
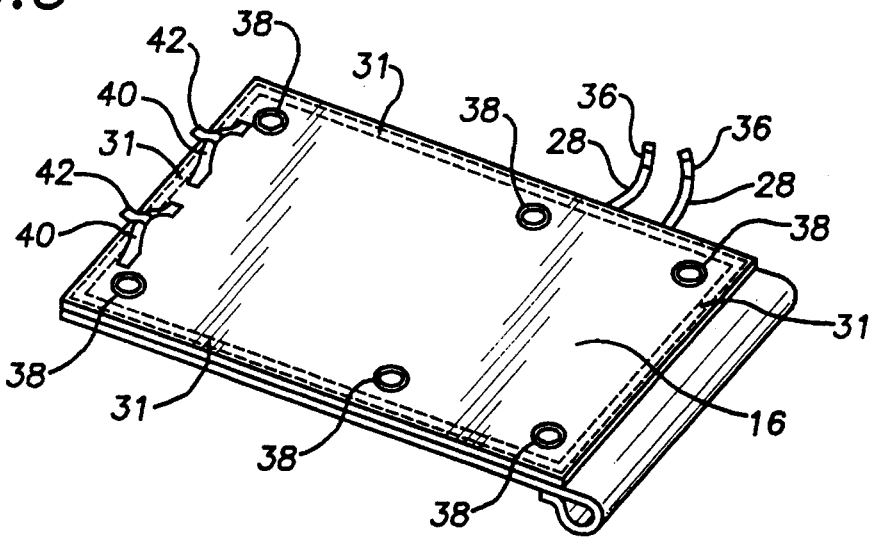
FIG. 3 is a bottom perspective view of the towel and liner members of the embodiment shown in FIG. 1.

FIG. 3 more clearly shows liner member 16 and the sections 36 of hook and pile fastener attached to the ends of each securing tab 28. As shown, liner member 16 includes six liner eyelets 38 and two carrying straps 40. Liner member 16 is constructed from plastic sheeting and is of substantially the same dimensions as towel member 12. Liner eyelets 38 are located on liner member 16 in a manner such that each liner eyelet 38 is in registration with one towel eyelet 20 when towel member 12 and liner member 16 are placed one atop the other. On the upper-side of liner member 16, a series of hook and pile fastener sections 31 (shown in dashed lines) are positioned along the perimeter. Sections 31 on liner member 16 attach to sections 19 on towel member 12 to form a detachable attachment between towel member 12 and liner member 16.

Carrying straps 40 are each constructed from two, eighteen inch lengths of nylon strapping connected by a buckle 42 which allows the length of each carrying strap 40 to be adjusted. Although carrying straps 40 are attached to liner member 16 in this embodiment, they may be attached to towel member 12 by stitching, gluing, or use of a connecting mechanism such as clips connected to the ends of each carrying strap which are connectable through the towel or liner eyelets.

Figure 4:
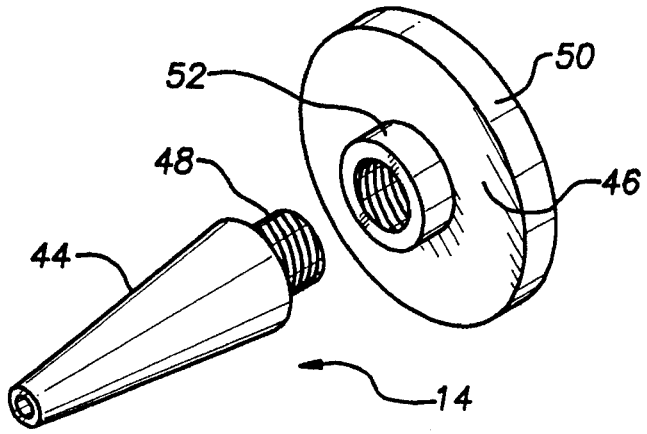
FIG. 4 is an exploded perspective view of a preferred embodiment of the stake member.

FIG. 4 is an exploded view of one of the stake members 14. Each stake member includes a shaft portion 44 and a cap portion 46. Shaft portion 44 is constructed of plastic and includes a threaded male connector 48. In this embodiment, cap portion 46 is constructed of plastic and includes a three sixteenths inch (3/16") thick disk portion 50 having a diameter of about two inches and an internally threaded female connector 52. In use, male connector 48 is threaded into female connector 52, the opposite end of shaft portion 44 is then inserted through towel and liner eyelets 20,38 and into the soil or sand. The thin thickness of disk portion 50 allows cap portion 46 to be positioned flush to the ground surface and the broad diameter provides a large surface area which helps prevents damage to unprotected feet in the event the cap portion is accidently stepped upon.

Figure 5:
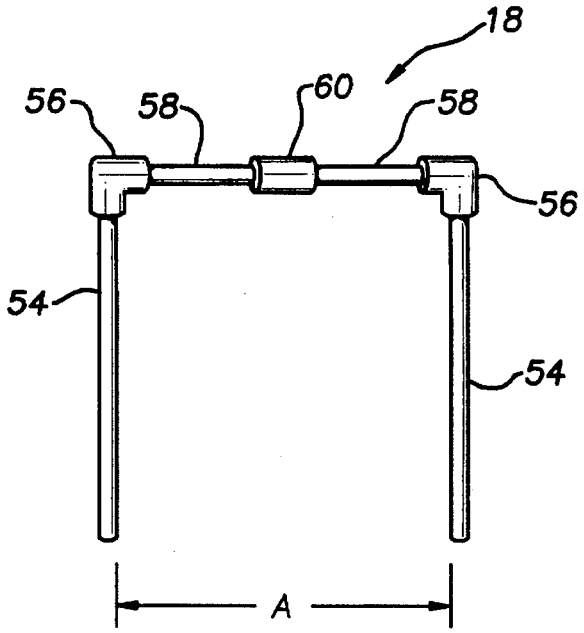
FIG. 5 is a side view of an assembled preferred embodiment of the support pole structure.
Figure 6:
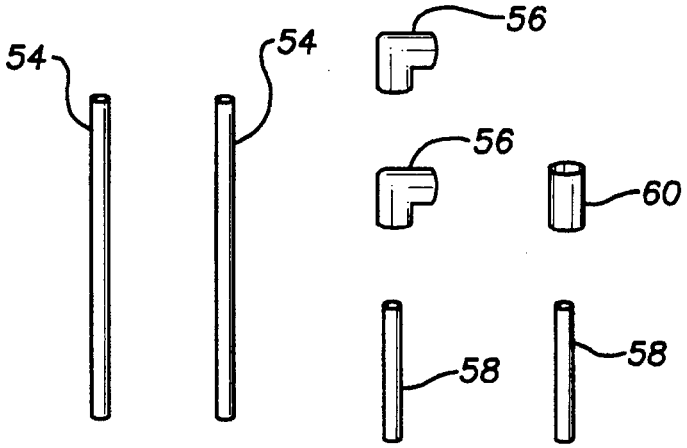
FIG. 6 is a disassembled side view of the embodiment of the support pole structure of FIG. 5.

FIG. 5 shows a preferred support pole structure 18 in isolation. Support pole structure 18 includes two vertical support poles 54, two right angle connectors 56, two horizontal connecting members 58, and a straight line connector 60. Each vertical support pole 54 has an outer diameter smaller than the aperture diameter of liner eyelets 38. The total effective length "A" of the horizontal connecting member is about one inch greater than the length of receiving structure 26. FIG. 6 shows support pole structure 18, including vertical support poles 54, right angle connectors 56, horizontal connecting members 58, and straight line connector 60, in the disassembled configuration in which it is stored within support pole storage pocket 24.

Use of the above described sun bathing towel system is simple. Towel member 12 and liner member 16 are placed in a desired position with liner member 16 between the earth surface and towel member 12. If it is desired to use the lean-to feature of the invention to protect food and/or drinks from the sun, the four stake members 14 are inserted through the four towel and liner eyelets 20,38 located farthest from receiving structure 26 and pushed down until the cap portion 46 of each stake member 14 is substantially flush with the ground surface. The horizontal connecting members 58 are connected using straight line connector 60 and passed through the receiving structure 26. Right angle connectors 56 are attached to each end of connecting members 58 and a vertical support pole 54 is installed into the other end of each right angle connector 56. The non-connected end of each vertical support pole 54 may then be inserted through the liner eyelets 38 and into the earth a desired distance. Of course, if desired, liner member 16 may remain attached to towel member 12 when the towel member 12 is in the lean-to configuration.

Figure 7:
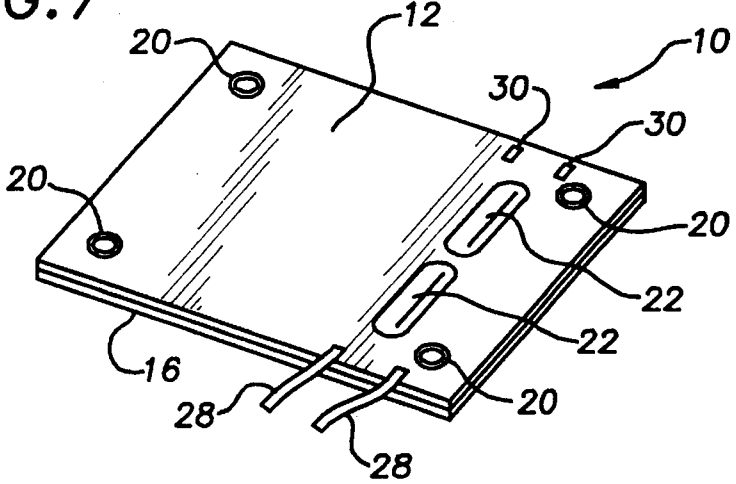
FIG. 7 is a top perspective view of another preferred towel and liner member.

FIG. 7 illustrates another exemplary embodiment of the sun bathing towel system 10 of the invention. In this embodiment, the lean-to feature of the previously described exemplary embodiment is omitted, including the support pole structure, the support pole storage pocket and receiving structure 2; and towel member 12 and liner member 16 are correspondingly shortened by the length of omitted section 32 (shown in FIG. 2 ). Towel member 12 includes four plastic towel eyelets 20, two pillow pockets 22, and two securing tabs 28 which are attachable to two securing pads 30. Also shown in the figure is a portion of liner member 16.

Figure 8:
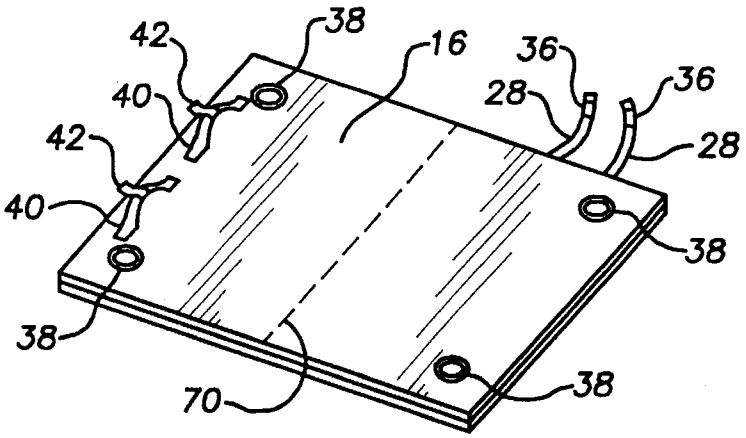
FIG. 8 is a bottom perspective view of the embodiment of the towel and liner member shown in FIG. 7.

FIG. 8 more clearly shows liner member 16 and the sections 36 of hook and pile fastener attached to the ends of each securing tab 28. As shown, liner member 16 includes four liner eyelets 38 and two carrying straps 40. As in the previous exemplary embodiment, each of the carrying straps 40 is constructed from two, eighteen inch lengths of nylon strapping connected by a buckle 42 which allows the length of each carrying strap 40 to be adjusted.

Figure 9:
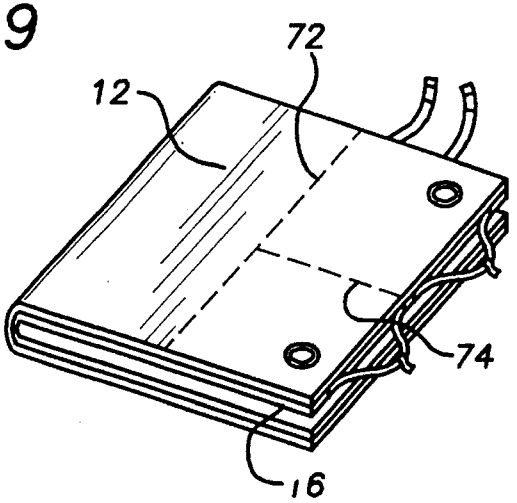
FIG. 9 is a perspective view showing the towel and liner members as they appear during one step of configuring the tote/carrying bag.
Figure 10:
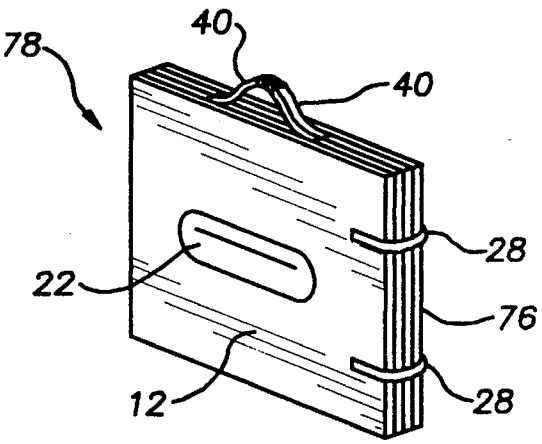
FIG. 10 is a perspective view showing the towel and liner member configured in the tote/carrying bag configuration.

Configuring the towel and liner members 12,16 into the tote/carrying bag configuration will now be described with reference to FIGS. 8–10. FIG. 8 shows the towel and liner members 12,16 with liner member 16 on top. The first step in the configuration is to fold towel and liner members 12,16 substantially along the dashed line 70 illustrated in FIG. 8 in a manner such that towel member 16 surrounds liner member 16 as shown in FIG. 9. Towel and liner member 12,16 are then folded in sequence substantially along dashed line 72 and then dashed line 74. The securing tabs 28 are then brought around the unfolded end 76, as shown in FIG. 10, and secured to securing pads 30 (not shown). Carrying straps 40 may then be used to carry the newly configured tote/carrying bag 78. When folded in this manner, pillow pockets 22 are located on both exterior sides of tote bag 78 and provide addition separate storage compartments when the inflatable pillows are deflated.

It can be seen from the preceding description that a sun bathing towel system which allows a sun bathing towel to be securely anchored without posing a danger to individuals, which allows sun bathing items to be conveniently carried to and from a sun bathing site, which provides protection for food and/or drink items from excessive exposure to the sun, and which provides a moisture barrier for carrying wet items has been provided.

It is noted that the embodiment of the sun bathing towel system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A sun bathing towel system comprising:

a towel member having perimeter and a plurality of towel eyelet members defining a like number of towel eyelet apertures, said towel eyelet members being located adjacent said perimeter of said towel member;

a plurality of stake members having a shaft portion and a detachably connectable cap portion, said cap portion having a broad top cap surface; and support pole means, connectable with said towel member, for supporting a portion of said towel member in a lean-to type fashion;

said towel member including at least one storage pocket for storing said support pole means and a tubular shaped structure having a first and second open end for receiving said horizontal connecting member, said tubular shaped structure being located along a perimeter portion of said towel member;

said support pole means including first and second vertical pole members, and at least one horizontal connecting member; said horizontal connecting member being attachable between said first and second vertical pole members.

2. The sun bathing towel system of claim 1 further including:

a liner member of substantially the same size and shape as said towel member and having a plurality of liner eyelet members, said liner eyelet members being located on said liner member in a manner to register with the locations of said towel eyelet members on said towel member when said towel member and said liner member are positioned one atop the other, said liner member having means for detachably connecting said liner member to said towel member.

3. The sun bathing towel system of claim 2 further including:

an elongated flexible carrying strap in functional connection with said towel member.

4. The sun bathing towel system of claim 2, wherein:

a first portion of said perimeter of towel member includes means for attachment to a second portion of said perimeter of said towel member in a manner such that said towel member forms a pouch.

5. The sun bathing towel system of claim 2 further including:

an elongated flexible carrying strap in functional connection with said towel member; and wherein:

a first portion of said perimeter of towel member includes means for attachment to a second portion of said perimeter of said towel member in a manner such that said towel member forms a pouch.

* * * * *